US010150538B1

(12) United States Patent
Salz

(10) Patent No.: US 10,150,538 B1
(45) Date of Patent: Dec. 11, 2018

(54) RESILIENT STRUCTURAL BOAT SEATING AND ROWING APPARATUS

(71) Applicant: David Salz, Davie, FL (US)

(72) Inventor: David Salz, Davie, FL (US)

( * ) Notice: Subject to any disclaimer, the term of this patent is extended or adjusted under 35 U.S.C. 154(b) by 0 days.

(21) Appl. No.: 15/130,519

(22) Filed: Apr. 15, 2016

Related U.S. Application Data

(60) Provisional application No. 62/148,412, filed on Apr. 16, 2015.

(51) Int. Cl.
*B63B 29/04* (2006.01)
*B60N 2/68* (2006.01)
*B60N 2/70* (2006.01)

(52) U.S. Cl.
CPC ..... *B63B 29/04* (2013.01); *B60N 2/682* (2013.01); *B60N 2/70* (2013.01); *B60N 2/7011* (2013.01); *B63B 2029/043* (2013.01)

(58) Field of Classification Search
CPC ..... B63B 29/04; B63B 2029/043; B63B 2035/715; B63H 16/02; A47C 5/04; A47C 5/06; A47C 5/08; A47C 5/10; B60N 2/70; B60N 2/7011
USPC ..... D06/368
See application file for complete search history.

(56) References Cited

U.S. PATENT DOCUMENTS 2,815,517 A * 12/1957 Andresen, Jr. ..... B63B 3/00 114/363
4,592,126 A * 6/1986 Bottemiller ..... A47C 5/06 29/446
6,691,633 B1 * 2/2004 Metzger ..... B63B 7/082 114/162
2009/0038526 A1 * 2/2009 Walton ..... B63B 29/04 114/347

* cited by examiner

*Primary Examiner* — Andrew Polay
(74) *Attorney, Agent, or Firm* — Malin Haley DiMaggio & Bowen, P.A.

(57) ABSTRACT

A self-tensioning seating system for boats with minimal wind resistance and enhanced accessibility. The seat material can be netting or a fibrous material allowing for wind to pass through. The seating system includes outwardly angled side rails having the profile of furniture, such as seats, chaize lounges, ottomans and the like. The side rails are secured within peripheral sleeves in the seat material. An embodiment of the invention provides a conversion with full body rowing functionality. The system provides robust simplified furniture frames that assemble without fasteners.

13 Claims, 5 Drawing Sheets

RESILIENT STRUCTURAL BOAT SEATING AND ROWING APPARATUS

CROSS REFERENCE TO RELATED APPLICATIONS

This application claims the benefit of U.S. Provisional Application No. 62/148,412, filed on Apr. 16, 2015.

STATEMENT REGARDING FEDERALLY SPONSORED RESEARCH OR DEVELOPMENT

N/A

BACKGROUND OF THE INVENTION

1. Field of the Invention

The present invention relates generally to seating for boats, and more particularly to unique designs for a side rail seating system having inherent tensioning features, minimal components and simplicity of operation.

2. Description of the Prior Art

Conventional boat seats are typically upholstered frame or molded plastic chairs, or alternatively comprise horizontal platforms with support cushions built into the interior hull or decks.

However, none of the conventional seating systems address the designs, components and/or operation of the instant side rail seating systems which are self-tensioning, flexible, user-friendly and relatively simple in structure and operation, and which constitutes a substantial improvement over the art.

It is therefore an objective of the present invention to provide an improved seating system for boats providing for comfortable seating which is user friendly and relatively simple in design, components and operation.

It is yet another objective of the present invention to provide an improved seating system for boats which is superior to prior designs and provides for flexible and self-tensioning seats which are also convertible for rowing configurations.

It is yet another objective of the present invention to provide an improved seating system for sailboats having minimal wind resistance and enhanced accessibility.

It is yet another objective of the present invention to provide an improved seating system for boats which incorporates unobtrusive side rails having quick release features interfacing with hull components.

Finally, it is an objective of the present invention to provide to provide an improved seating system for boats which is cost effective and operationally efficient while incorporating the above mentioned objects and features.

SUMMARY OF THE INVENTION

The instant inventions comprise a flexible seating system utilizing outwardly diverging side rails that are secured within receptive mounts or sockets in the hull sides or gunwales of the vessel. A mesh fabric or net having sleeved edges is first fit over the rails, the rails being slid within the sleeves on opposite sides of the net. The rails have lower sections functioning as peg inserts, which are secured into angled sockets within the gunwales. Alternative embodiments utilize cross rails in place of hull sockets for general seating applications. The side rails have a general vertical side seat profile, and the net is placed about opposite side rails forming the complete seat. Outward angling of the side rails facilitates tensioning and locking functions without the need for fasteners.

BRIEF DESCRIPTION OF THE DRAWINGS

The invention may be better understood by reference to the drawings in which.

DETAILED DESCRIPTION OF PREFERRED EMBODIMENTS

Figure 1A:
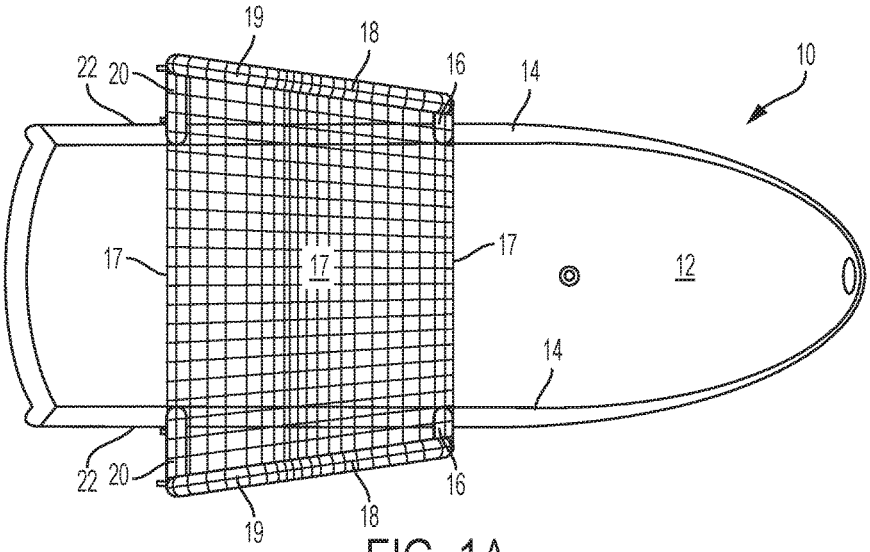
FIG. 1A is a top plan view of the inventive seating system secured to the hull of a vessel.

With reference to FIG. 1A, the instant sailboat seating system 10 secured to boat hull 12 is illustrated, one purpose being user comfort with minimal wind resistance and improved accessibility. Boat hull 12 includes side gunwales 14, and in this embodiment, mounting sockets 22. Tubular side rails are inserted into the hull sockets. The tubular side rails 18 include a central section, and forward sections 16 and rear sections 20 which fit into sleeved peripheral edges 19 of net 17. Alternatives to the net 17 include meshed fabric or similar materials which are wind resistant allowing for airflow there through. Tubular side rails sections 16 and 20 also fit within two mounting sockets 22 about the hull gunwales.

Figure 1B:
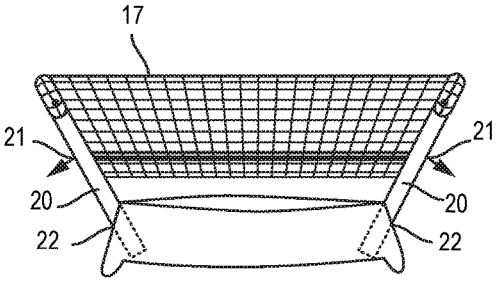
FIG. 1B is a rear view of the apparatus shown in FIG. 1A.
Figure 1C:
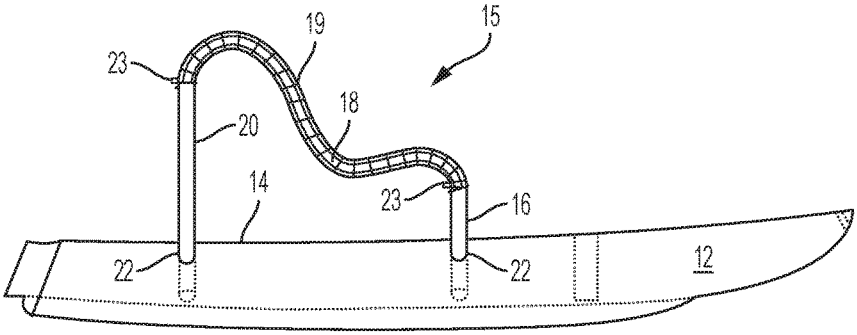
FIG. 1C is a side view of the apparatus shown in FIG. 1A.

FIG. 1B is a rear view of the seating system illustrated in FIG. 1A. FIG. 1C is a side view of the seating system illustrated in FIG. 1A, and illustrates the side seat profile created by the side rails. The side seat profile 15 is illustrated with a seat section and a back support section as in conventional chairs or sofas.

As indicated, the tubular side rails are supported by sockets in the sides of the hull, wherein opposite sides of the side rails themselves include lower sections which are inserted into the hull sockets in a male member-female member configuration. The side rails can include pegs for securing the net and various accessories, or tapered end sections which fit with within the sockets.

The seating surface can be a textile net stretched tightly between the side rails. The sides of the net or fiber material have the sleeves mentioned about its periphery, and the rails fit within the sleeves. One particular material, UHMWPE fiber, is particularly suited for such use, and the rails are preferably made of lightweight aluminum, although other suitable materials can be utilized forming the side rails.

With reference to FIG. 1B, it can be seen that the rear sections 20 of the side rails are angled in an outward direction 21 away from the hull. The outward angling of the rails is a key element of the novel net tensioning system. Assembly begins by inserting the rails into the hull while the net 17 is pulled down to the lower, narrower front end sections 16. As the net is pulled toward the taller rear end sections 20 of the rails, the increased width between rails, because of the outward angling and the front sections 16 being shorter than the rear sections 20, creates tension in the net. Note the general trapezoidal shape of the net 17 illustrated in FIG. 1A, which is created by the side rail sections mentioned in the outward angling.

In the tensioned mode, the net is secured at the top end of the rails by pegs 23 as seen in FIG. 1C, the pegs protruding through holes in the net. The net tension also locks the rails into the hull and it can also lock the rails into other structures or cross rails to create general purpose seating.

This seating structure also solves accessibility issues for people with limited mobility. In addition to providing a stable and supportive seating surface, the angled side rails 18 extend the width of the seat beyond the sides of the hull as illustrated. With the boat moored alongside a low floating dock, the side overhang enables sailors to board the boat laterally, and from a wheelchair if necessary. Furthermore, the simple control system of the boat is extremely adaptable to control modifications that overcome individual physical limitations.

Figure 2A:
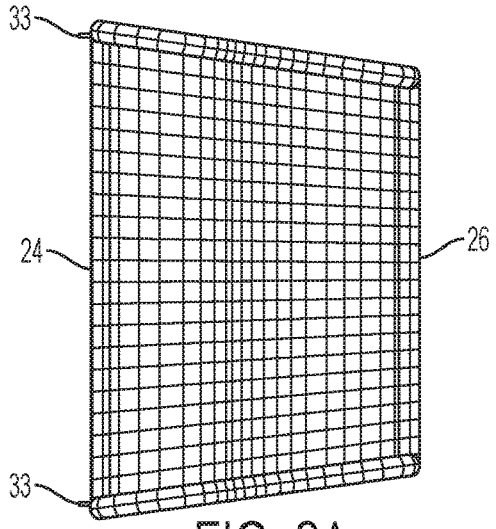
FIG. 2A is a top plan view of an alternative embodiment of the inventive seating system.
Figure 2B:
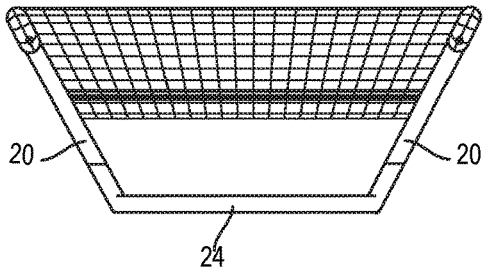
FIG. 2B is a rear view of the apparatus shown in FIG. 2A.
Figure 2C:
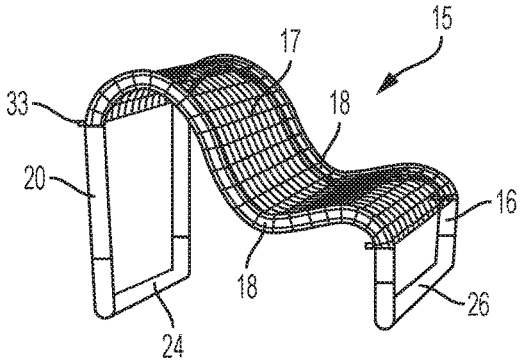
FIG. 2C is a perspective view of the apparatus shown in FIG. 2A.

FIGS. 2A, 2B and 2C illustrate an alternative embodiment for the tensioned net furniture. In this embodiment, lower cross rails 24 and 26 are used to receive side rail sections 16 and 20. In this embodiment, the side rails are not secured directly to gunwale sockets, but alternatively thereto, are received within and secured by lower cross rails 24 and 26 respectively. The cross rails are placed within a lower deck area of the hull, and can either be secured thereto or be freely movable. Side rails 18, and sections 16 and 20, are inserted within receptive sockets or sleeves of cross rails 24 and 26.

FIG. 2C is a perspective view of one particular chair of the tensioned net furniture, which illustrates the profile of the chair having a conventional seat support and back support. Sliding the net forward about the rails releases the side to side tension. Sliding the net rearwardly creates the side to side tension that supports the user(s), and locks the side rails into the sockets of the bottom cross rails 24 and 26. Pegs 33 secure the net as indicated above. This same tensioning system, outward angling and seating applies to a variety of products, including chairs, loveseats, chaise lounges, and ottomans amongst others. These structures may also be used to replace the conventional frames inside padded and upholstered furniture. Those embodiments may utilize removable covers that enable the item to be disassembled for efficient transport.

Figure 3A:
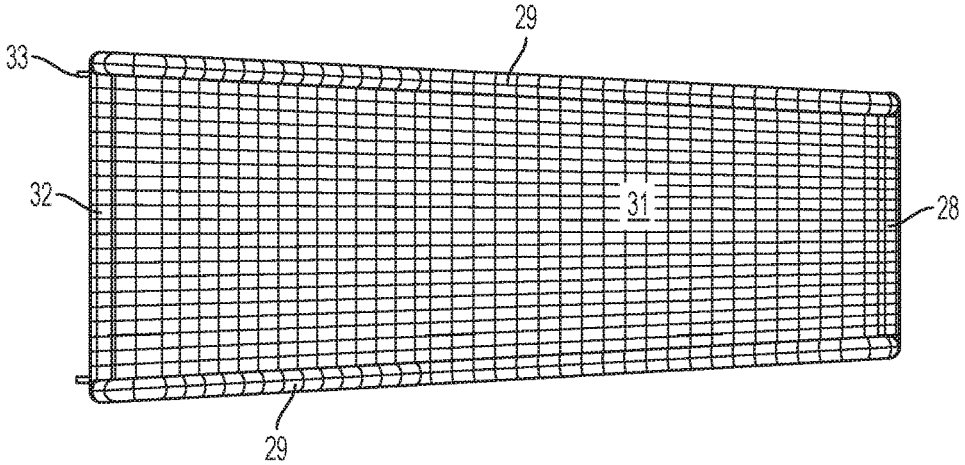
FIG. 3A is a top plan view of an alternative embodiment of the inventive seating system.
Figure 3B:
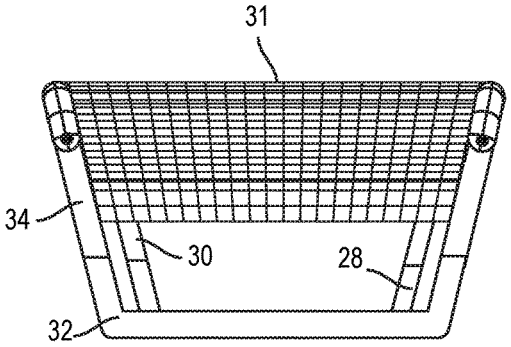
FIG. 3B is a rear view of the apparatus shown in FIG. 3A.
Figure 3C:
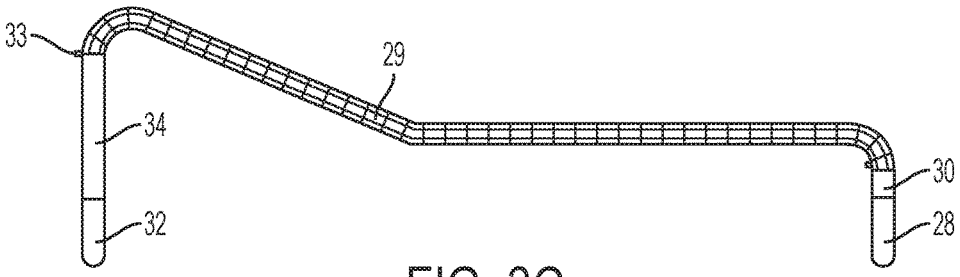
FIG. 3C is a side view of the apparatus shown in FIG. 3A.

FIGS. 3A, 3B and 3C illustrate the instant seating system in the embodiment of a tensioned chaise lounge. Side rails 29 are shaped to that of a conventional chaise lounge profile, and can be modified in design accordingly. Bottom cross rails 28 and 32 receive side rail sections 30 and 34 respectively. Net seating section 31 is assembled about side rails in the same fashion as indicated above with FIGS. 1A through 2C.

Figure 4A:
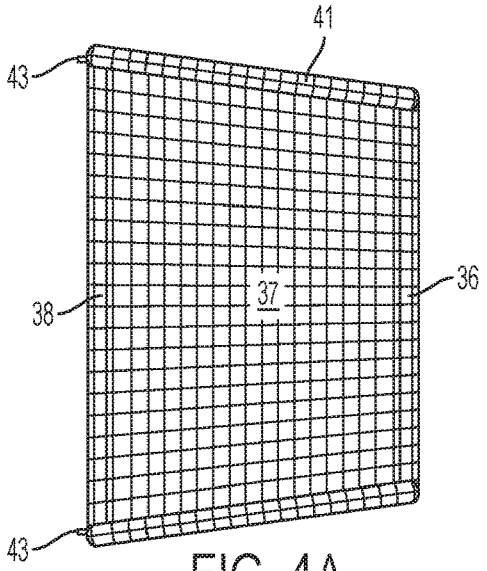
FIG. 4A is a top plan view of an alternative embodiment of the inventive seating system.
Figure 4B:
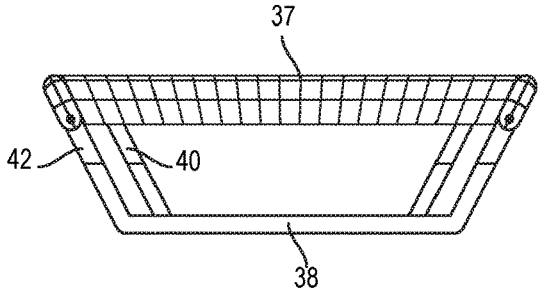
FIG. 4B is a rear view of the apparatus shown in FIG. 4A.
Figure 4C:
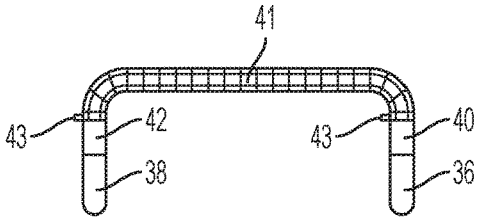
FIG. 4C is a side view of the apparatus shown in FIG. 4A.

FIGS. 4A, 4B and 4C illustrate the instant seating system in the embodiment of a tensioned net/mesh fabric ottoman. Side rails 41 are shaped to that of a conventional ottoman profile, and can be modified in design accordingly. Bottom cross rails 36 and 38 receive side rail sections 40 and 42 respectively. Net seating section 37 is assembled about side rails in the same fashion as indicated above with FIGS. 1A through 2C. Note in the embodiment, front rail sections 40 and 42 are the same height creating the generally level ottoman. Pegs 43 secure the net 37 to the rails.

Joining the side rails and cross rails with a textile membrane creates a fundamentally simple self-tensioning structure with the extraordinary physical characteristic of uniformly distributed tension. This rare attribute, known as distributed compliance, is a structural ideal that maximizes strength and stability without rigidity or high tension. This advantage does not exist in previous framed seating structures, which are classified as lumped compliance devices because they concentrate tension on one or more points. Benefits of distributed compliance include self-stabilization, extreme reliability and safety.

Figure 5A:
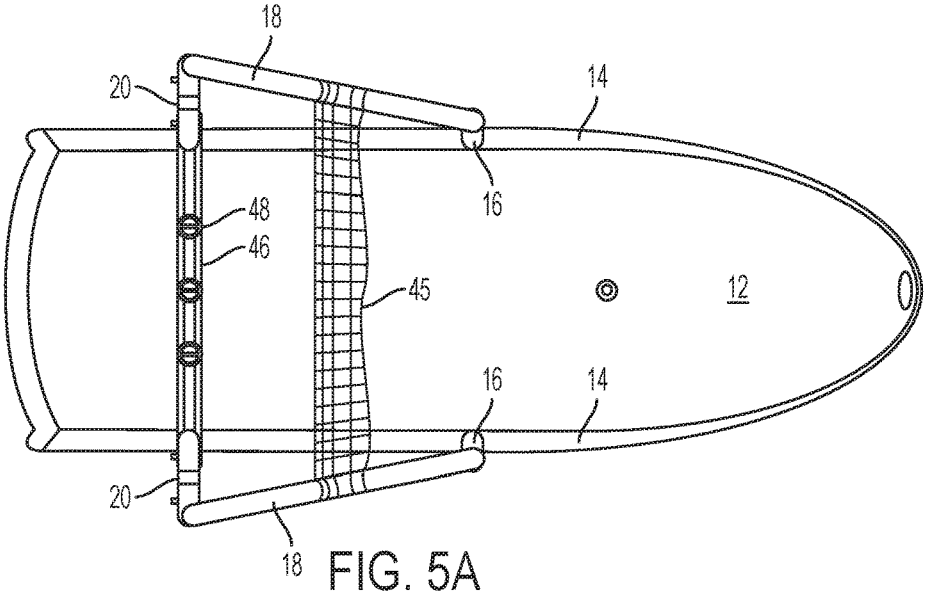
FIG. 5A is a top plan view of the inventive seating system secured to the hull of a vessel, in an alternative embodiment and configuration for rowing.
Figure 5B:
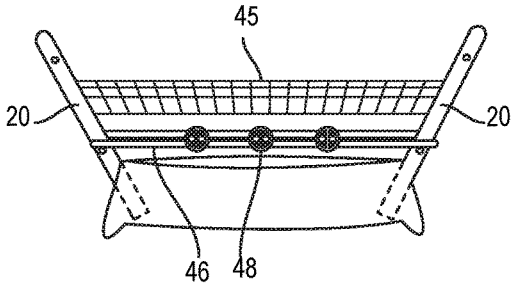
FIG. 5B is a rear view of the apparatus shown in FIG. 5A.
Figure 5C:
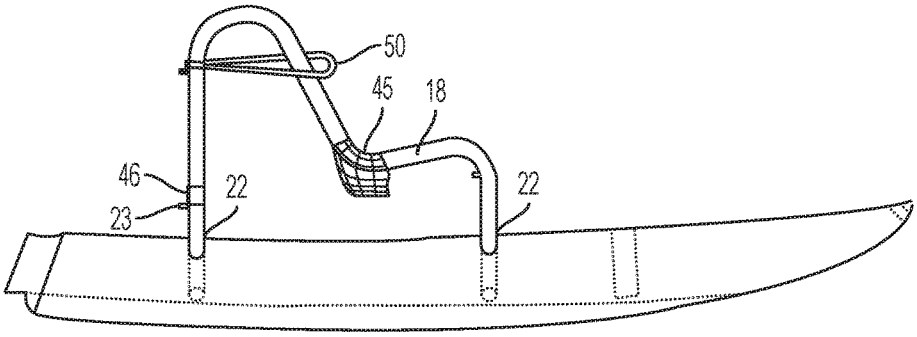
FIG. 5C is a side view of the apparatus shown in FIG. 5A.

With reference to FIGS. 5A through 5C, an alternative embodiment of the instant invention is depicted with respect to a boat hull with the novel seating system being utilized in a configuration for a rowing swing. The rail structure is seen to be that as shown and described with FIGS. 1A through 1C. However, to be utilized for rowing, the sleeved sides of the seating net become a rowing seat 45 when the net is bunched inwardly from opposite ends creating the relatively narrow seat utilized for rowing. A tensioned strap 46, along with a plurality of buckles 48, are placed around side rail sections 20 as indicated, and provide a rowing footrest. The tensioned straps 46 are held in place by pegs 23. Finally, two straps/ropes 50 are utilized to function as oarlocks.

The tensioned net seat functions as a full body rowing system. In the rowing mode, the net is bunched together at the central low point of the rails. In that position, the net can swing fore and aft. This swing seat is a novel replacement for the sliding seats and other moving parts used in conventional full body rowing devices. The footrests are formed by a tensioned strap with three buckles and rail pegs that control strap height. The rower's feet fit into spaces between the two sides of the strap and the buckles. The oarlocks formed by the ropes or straps fit over the rails and are secured by rail pegs as indicated. Changing between rowing and seating modes is quick and simple with this system.

Despite previous attempts to create practical boat seating systems within obvious design constraints, there have been relatively few advances in the art. The most significant differences between the current inventions and previous designs are the means employed to support the self-tensioning wind resistant material in a seat profile with minimal structural components.

The above inventions have been described and illustrated with the reference structure, components and functions. Modifications and variations thereof will occur to those of ordinary skill in the art, and it is intended such modifications and variations will be within the scope of the inventive subject matter.

What is claimed is:

1. A tensioned, flexible and wind resistant seating system for a boat hull having gunwales, comprising:

a plurality of side rails;

said side rails having forward and rear sections which are secured to said gunwales;

said side rails being angled upwardly and outwardly from said hull;

said seating system having no cross-rails; and a flexible seat material, said side rails supporting said seat material, said flexible seat material being wind resistant and deformable.

2. The apparatus of claim 1, further comprising:

said flexible seat material being in moveable engagement with said side rails.

3. The apparatus of claim 2, further comprising:

said flexible seat material being moveable in sliding engagement with said side rails;

wherein sliding said seat material forward releases side-to-side tension and sliding said seat material rearward creates side-to-side tension; and said tension configured to support users and locks said side rails in place as secured to said gunwales.

4. The apparatus of claim 1, further comprising:

said side rails extending beyond said gunwales of said hull.

5. The apparatus of claim 1, further comprising:

said side rails being shaped to define the profile of furniture.

6. The apparatus of claim 3, further comprising:

said side rails having central sections interposed said forward and rear sections;

said forward sections being lower than said rear sections; and said central sections defining the profile of said furniture.

7. The apparatus of claim 1 wherein said flexible seat material is netting.

8. The apparatus of claim 1 wherein said flexible seat material is fibrous.

9. The apparatus of claim 1 wherein said flexible seat material is a textile membrane.

10. The apparatus of claim 1, further comprising:

said side rails having terminating male sections;

said hull gunwales having receiving female members;

said side rail male sections inserted and secured within said gunwale female members.

11. The apparatus of claim 1, further comprising:

said flexible seat material secured to said side rails with peripheral sleeves; and said flexible seat material being secured to said angled outwardly side rails creating inherent tension in said seating system.

12. A tensioned, flexible and wind resistant seating and rowing system for a boat hull having gunwales, comprising:

a plurality of side rails;

said side rails having forward and rear sections which are secured to said gunwales;

said side rails being angled upwardly and outwardly from said hull;

a flexible seat material, said side rails supporting said seat material, said flexible seat material being wind resistant and deformable;

said flexible seat material being moveable in sliding engagement about said side rails; and said flexible seat material being convertible from a seating configuration to a rowing configuration.

13. The apparatus of claim 12, further comprising:

tensioned straps secured about said side rails rear sections; said tensioned straps being a footrest for rowing;

oarlocks secured about said side rails rear sections; and means for positioning said oarlocks.

* * * * *